US008496486B2

(12) United States Patent
Szczesny et al.

(10) Patent No.: US 8,496,486 B2
(45) Date of Patent: Jul. 30, 2013

(54) TRANSCEIVER ASSEMBLY

(75) Inventors: David Stanley Szczesny, Hershey, PA (US); Michael Eugene Shirk, Grantville, PA (US); Bruce Allen Champion, Lemoyne, PA (US); Michael Frank Cina, Elizabethtown, PA (US); Michael Warren Fogg, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/183,342

(22) Filed: Jul. 14, 2011

(65) Prior Publication Data

US 2012/0015563 A1 Jan. 19, 2012

Related U.S. Application Data

(60) Provisional application No. 61/365,679, filed on Jul. 19, 2010.

(51) Int. Cl.
*H01R 12/00* (2006.01)

(52) U.S. Cl.
USPC ..... 439/79

(58) Field of Classification Search
USPC ..... 439/79, 64, 108, 541.5, 947
See application file for complete search history.

(56) References Cited

U.S. PATENT DOCUMENTS

| | | | | |
|---|---|---|---|---|
| 4,331,370 | A * | 5/1982 | Andrews et al. | 439/75 |
| 5,236,368 | A * | 8/1993 | Adams et al. | 439/79 |
| 5,308,248 | A * | 5/1994 | Davidge et al. | 439/59 |
| 5,322,447 | A * | 6/1994 | Okada | 439/79 |
| 5,709,555 | A * | 1/1998 | Noschese | 439/79 |
| 5,754,796 | A * | 5/1998 | Wang et al. | 710/301 |
| 6,000,955 | A * | 12/1999 | Zaderej | 439/79 |
| 6,231,355 | B1 | 5/2001 | Trammel et al. | |
| 6,247,937 | B1 * | 6/2001 | Miwa et al. | 439/59 |
| 6,350,134 | B1 | 2/2002 | Fogg et al. | |
| 6,540,559 | B1 | 4/2003 | Kemmick et al. | |

* cited by examiner

*Primary Examiner* — Phuong Dinh

(57) ABSTRACT

A receptacle connector is provided for mating with a pluggable module having a plug and a printed circuit. The receptacle connector includes a housing having a mating receptacle and a slot. The mating receptacle is configured to receive the plug of the pluggable module therein. The slot is configured to receive the printed circuit of the pluggable module therein. A receptacle contact is held by the housing. The receptacle contact includes a receptacle mating segment that extends within the mating receptacle and is configured to engage a mating contact of the plug of the pluggable module. A slot contact is held by the housing. The slot contact includes a slot mating segment that extends within the slot and is configured to engage the printed circuit of the pluggable module.

19 Claims, 8 Drawing Sheets

TRANSCEIVER ASSEMBLY

BACKGROUND OF THE INVENTION

The subject matter described and/or illustrated herein relates generally to transceiver assemblies, and more particularly, to receptacle connectors and pluggable modules for use in transceiver assemblies.

Various types of fiber optic and copper based transceiver assemblies that permit communication between host equipment and external devices are known. These transceiver assemblies typically include a module assembly that can be pluggably connected to a receptacle connector in the host equipment to provide flexibility in system configuration. The module assemblies are constructed according to various standards for size and compatibility, one standard being the Quad Small Form-factor Pluggable (QSFP) module standard. Conventional QSFP modules and receptacle assemblies perform satisfactorily conveying data signals at rates up to 10 gigabits per second (Gbps). Another pluggable module standard, the XFP standard, calls for the transceiver module to also convey data signals at rates up to 10 Gbps.

As electrical and optical devices become smaller, the signal paths thereof become more densely grouped. Moreover, the rate at which the electrical data signals propagate along the signal paths is continually increasing to satisfy the demand for faster electrical devices. Accordingly, there is a demand for transceiver assemblies that can handle the increased signal rates and/or that have a higher density of signal paths. However, because of the increased signal rates and/or higher density, the signal contacts, or terminals, within a transceiver assembly may electrically interfere with each other, which is commonly referred to as "crosstalk". Such crosstalk can become a relatively large contributor to errors along the signal paths of the transceiver assembly. Moreover, the increased signal rates and/or higher density may make it difficult to maintain a desired impedance value of the transceiver assembly, which may result in impedance discontinuities between the transceiver assembly and the host equipment and/or the external device.

BRIEF DESCRIPTION OF THE INVENTION

In one embodiment, a receptacle connector is provided for mating with a pluggable module having a plug and a printed circuit. The receptacle connector includes a housing having a mating receptacle and a slot. The mating receptacle is configured to receive the plug of the pluggable module therein. The slot is configured to receive the printed circuit of the pluggable module therein. A receptacle contact is held by the housing. The receptacle contact includes a receptacle mating segment that extends within the mating receptacle and is configured to engage a mating contact of the plug of the pluggable module. A slot contact is held by the housing. The slot contact includes a slot mating segment that extends within the slot and is configured to engage the printed circuit of the pluggable module.

In another embodiment, an electrical connector assembly includes a pluggable module having a plug and a printed circuit. The plug includes a mating contact. The electrical connector assembly also includes a receptacle connector having a housing including a mating receptacle and a slot. The mating receptacle receives the plug of the pluggable module therein. The slot receives the printed circuit of the pluggable module therein. A receptacle contact is held by the housing. The receptacle contact includes a receptacle mating segment that extends within the mating receptacle and engages the mating contact of the plug. A slot contact is held by the housing. The slot contact includes a slot mating segment that extends within the slot and engages the printed circuit.

In another embodiment, a transceiver assembly includes a pluggable module having a module printed circuit and a plug that includes a mating contact. The transceiver assembly also includes a host printed circuit, and a receptacle connector mounted on the host printed circuit. The receptacle connector includes a housing having a mating receptacle and a slot. The mating receptacle receives the plug of the pluggable module therein. The slot receives the module printed circuit of the pluggable module therein. A receptacle contact is held by the housing. The receptacle contact includes a receptacle mating segment that extends within the mating receptacle and engages the mating contact of the plug of the pluggable module. A slot contact is held by the housing. The slot contact includes a slot mating segment that extends within the slot and engages the printed circuit of the pluggable module.

DETAILED DESCRIPTION OF THE INVENTION

Figure 1:
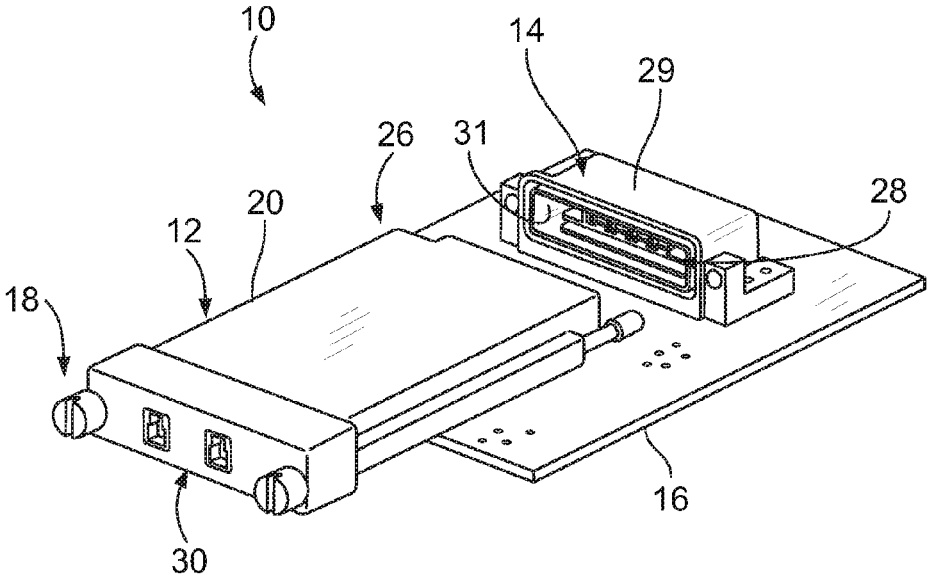
FIG. 1 is a perspective view of a portion of an exemplary embodiment of a transceiver assembly.

FIG. 1 is a perspective view of a portion of an exemplary embodiment of a transceiver assembly 10. In the exemplary embodiment, the transceiver assembly 10 is adapted to address, among other things, conveying data signals at high rates, such as data transmission rates of at least 10 gigabits per second (Gbps), which is required by the SFP+ standard. For example, in some embodiments the transceiver assembly 10 is adapted to convey data signals at a data transmission rate of at least 25 Gbps. Moreover, and for example, in some embodiments the transceiver assembly 10 is adapted to convey data signals at a data transmission rate of between approximately 20 Gbps and approximately 30 Gbps. It is appreciated, however, that the benefits and advantages of the subject matter described and/or illustrated herein may accrue equally to other data transmission rates and across a variety of systems and standards. In other words, the subject matter described and/or illustrated herein is not limited to data transmission rates of 10 Gbps or greater, any standard, or the exemplary type of transceiver assembly shown and described herein.

The transceiver assembly 10 includes a pluggable module 12 configured for pluggable insertion into a receptacle assembly 14 that is mounted on a host printed circuit 16. The host printed circuit may be mounted in a host system (not shown) such as, but not limited to, a router, a server, a computer, and/or the like. The host system typically includes a conductive chassis (not shown) having a bezel (not shown) including an opening (not shown) extending therethrough in substantial alignment with the receptacle assembly 14. The receptacle assembly 14 is optionally electrically connected to the bezel. The pluggable module 12 is configured to be inserted into the receptacle assembly 14. Specifically, the pluggable module 12 is inserted into the receptacle assembly 14 through the bezel opening such that a front end 18 of the pluggable module 12 extends outwardly from the receptacle assembly 14. The pluggable module 12 includes a housing 20 that forms a protective shell for a printed circuit 22 (FIGS. 2, 4, 8, and 10) that is disposed within the housing 18. The printed circuit 22 carries circuitry, traces, paths, devices, and/or the like that perform transceiver functions in a known manner. An edge 24 (FIGS. 2 and 8) of the printed circuit 22 is exposed at a rear end 26 of the housing 20. The edge 24 is pluggable into the receptacle assembly 14 as described below. The printed circuit 22 may be referred to herein as a "module printed circuit".

In general, the pluggable module 12 and the receptacle assembly 14 may be used in any application requiring an interface between a host system and electrical and/or optical signals. The pluggable module 12 interfaces to the host system through the receptacle assembly 14 via a receptacle connector 28 of the receptacle assembly 14. Optionally, the receptacle assembly 14 includes a cover 29 that extends over the receptacle connector 28 and includes a port 31 for receiving the pluggable module 12 therethrough. The pluggable module 12 interfaces to one or more optical cables (not shown) and/or one or more electrical cables (not shown) through a connector interface 30 at the front end 18. The receptacle connector 28 and the pluggable module 12 may each be referred to herein as a "mating connector".

Figure 2:
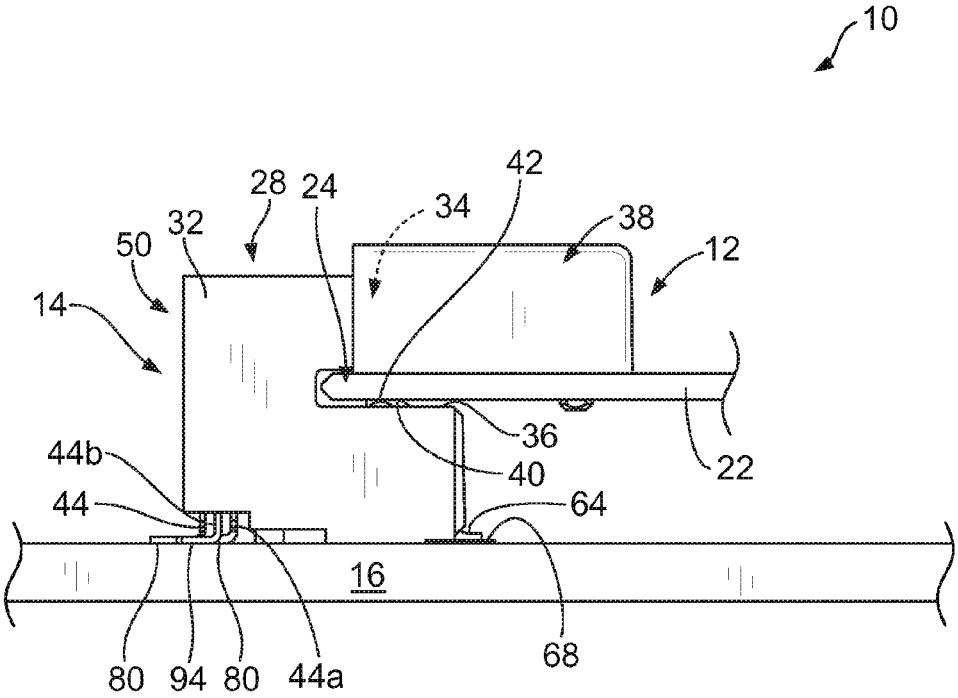
FIG. 2 is an elevational view of a portion of the transceiver assembly shown in FIG. 1 illustrating an exemplary embodiment of a pluggable module mated with an exemplary embodiment of a receptacle connector.

FIG. 2 is an elevational view of a portion of the transceiver assembly 10 illustrating the pluggable module 12 mated with the receptacle connector 28. The cover 29 of the receptacle assembly 14 and the housing 20 of the pluggable module 12 have been removed from FIG. 2 for clarity. The receptacle connector 28 is mounted on the host printed circuit 16. The receptacle connector 28 includes a housing 32 having a mating interface 34 and a slot 36. The pluggable module 12 includes the printed circuit 22 and a plug connector 38. The slot 36 of the receptacle connector 28 receives the edge 24 of the printed circuit 22 when the pluggable module 12 is mated with the receptacle connector 28. The receptacle connector 28 includes contacts 40 that extend within the slot 36 and engage terminations 42 on the printed circuit 22 to establish an electrical and/or optical connection between the printed circuit 22 and circuitry, traces, paths, devices, and/or the like on the host printed circuit 16. Each of the contacts 40 may be referred to herein as a "slot contact". The housing 32 may be referred to herein as a "receptacle housing".

The receptacle connector 28 is configured to mate with the plug connector 38 of the pluggable module 12 at the mating interface 34 to establish an electrical and/or optical connection between the plug connector 38 and the receptacle connector 28. The receptacle connector 28 includes contacts 44 that extend along the mating interface 34 and engage contacts, or terminals, 46 (FIGS. 4, 5, 9, and 10) of the plug connector 38 to establish an electrical and/or optical connection between the printed circuit 22 and circuitry, traces, paths, devices, and/or the like on the host printed circuit 16. Each of the contacts 44 may be referred to herein as a "receptacle contact", and each of the terminals 46 may be referred to herein as a "mating contact".

The receptacle connector 28 may be considered to be a hybrid connector because the receptacle connector 28 mates with the pluggable module 12 at two different sub-connectors. More particularly, the receptacle connector 28 includes both the slot 36, which mates with the printed circuit 22, and the mating interface 34 (described in more detail below), which mates with the plug connector 38. The slot 36 and the associated contacts 40 can be considered to constitute a first of the two different sub-connectors of the receptacle connector 28, while the mating interface 34 and the associated contacts 44 can be considered to be the second of the two different sub-connectors. Similarly, the pluggable module 12 may be considered to be a hybrid connector because the pluggable module 12 includes both the printed circuit edge 24, which mates with slot 36, and the plug connector 38, which mates with the mating interface 34 of the receptacle connector 28.

Optionally, some or all of the contacts 44 of the receptacle connector 28 that mate with the terminals 46 of the plug connector 38 convey data signals at a higher rate than some or all of the contacts 40 that extend within the slot 36 for mating with the terminations 42 on the printed circuit 22. For example, in some embodiments, signal contacts 44*a* of the contacts 44 convey data signals at a data rate of at least 10 Gbps, while the contacts 40 convey data signals at less than 10 Gbps. Moreover, and for example, in some embodiments the signal contacts 44*a* convey data signals at a data transmission rate of at least 25 Gbps, while the contacts 40 convey data signals at less than 25 Gbps. Moreover, and for example, in some embodiments the signal contacts 44*a* convey data signals at a data transmission rate of between approximately 20 Gbps and approximately 30 Gbps, while the contacts 40 convey data signals at less than 20 Gbps. In other embodiments, some or all of the contacts 44 of the receptacle connector 28 convey data signals at approximately the same or a lesser rate than some or all of the contacts 40 of the receptacle connector 28.

Figure 3:
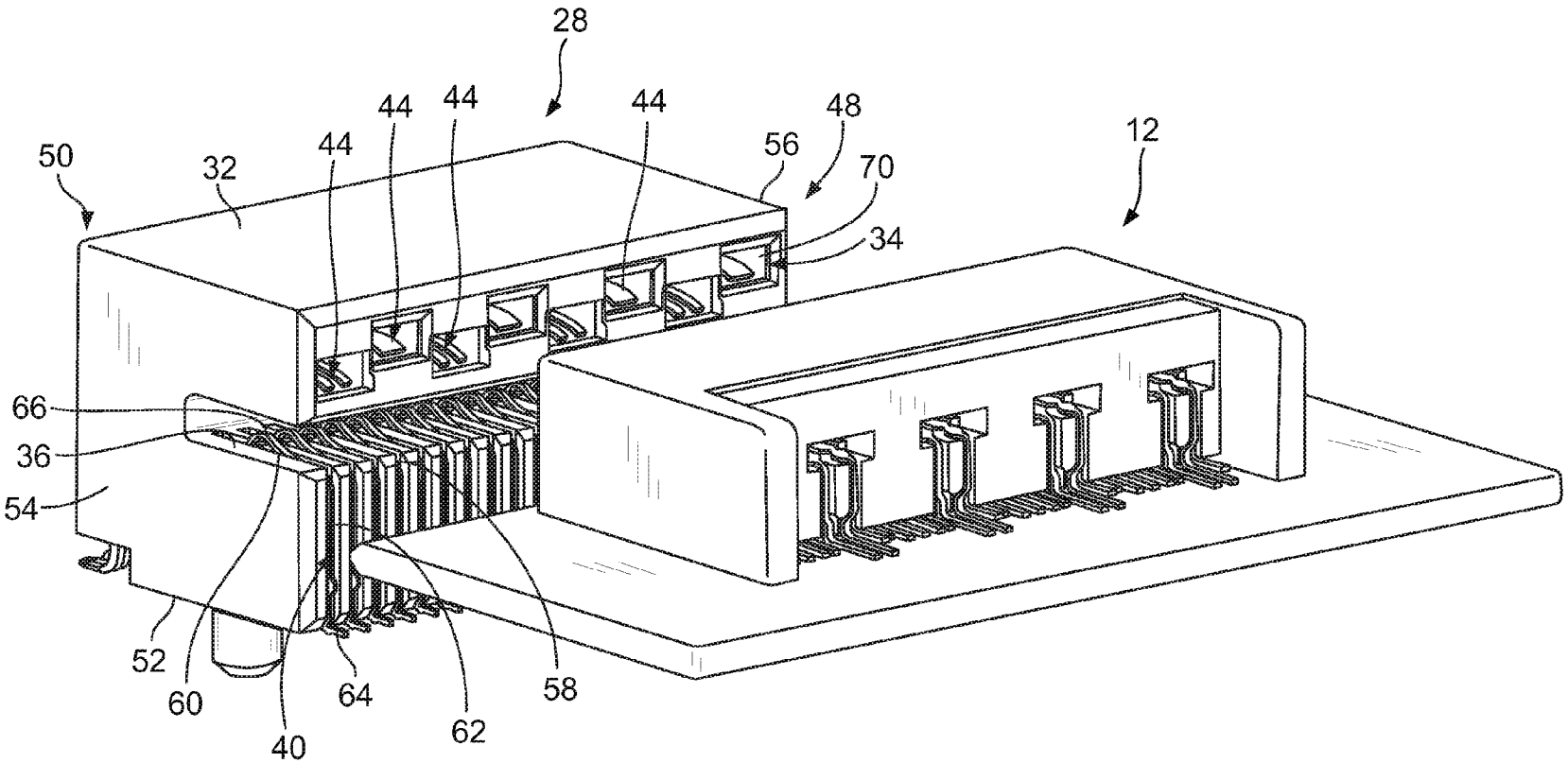
FIG. 3 is a perspective view of the receptacle connector and the portion of the pluggable module shown in FIG. 2 illustrating the receptacle connector and the pluggable module in an unmated position.
Figure 4:
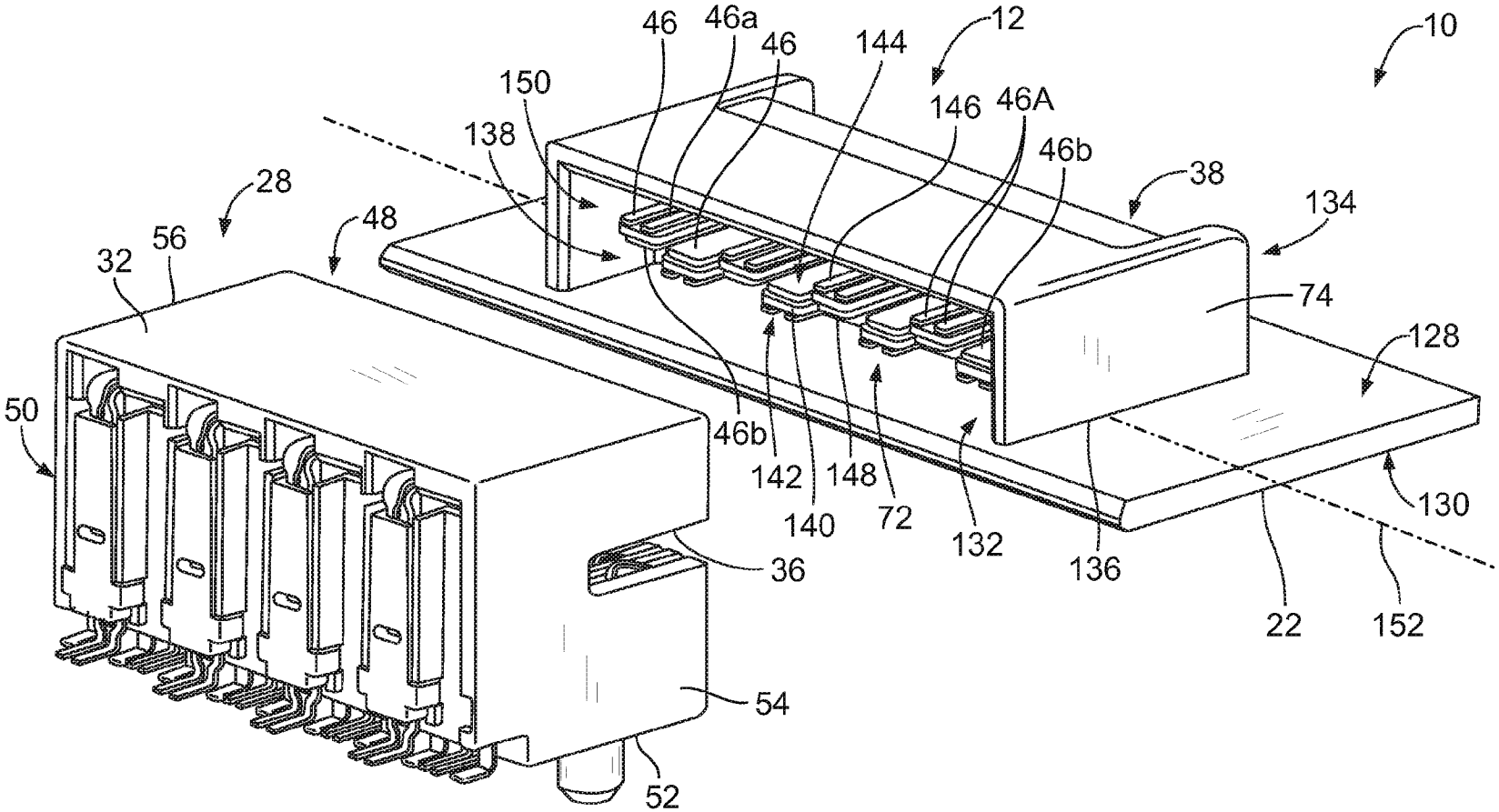
FIG. 4 is a perspective view of the receptacle connector and the pluggable module taken from a different angle than FIG. 3.

FIG. 3 is a perspective view of the receptacle connector 28 and a portion of the pluggable module 12 illustrating the receptacle connector 28 and the pluggable module 12 in an unmated position. FIG. 4 is a perspective view of the receptacle connector 28 and the pluggable module 12 taken from a different angle than FIG. 3. Referring now to FIGS. 3 and 4, the receptacle connector 28 will now be described. The receptacle connector 28 includes the housing 32, which extends from a front end 48 to a rear end 50 and includes a bottom side 52. FIG. 3 illustrates the front end 48 of the housing 32, while FIG. 4 illustrates the rear end 50. The housing 32 is configured to be mounted on the host printed circuit 16 (FIGS. 1, 2, and 7) at the bottom side 52. The front end 48 of the housing 32 includes the mating interface 34 (not visible in FIG. 4) and the slot 36. More particularly, the slot 36 extends through the front end 48 and into the housing 32 toward the rear end 50. The slot 36 optionally extends through one or both opposite sides 54 and 56 of the housing 32.

Referring now solely to FIG. 3, the contacts 40 of the receptacle connector 28 are held by the housing 32. The housing 32 includes a plurality of grooves 58 that receive corresponding contacts 40 therein. The grooves 58 may facilitate holding the contacts 40 in position relative to one another (e.g. side-to-side position). The contacts 40 include mating segments 60, intermediate segments 62, and mounting feet 64. The mating segments 60 extend within the slot 36 and include mating surfaces 66 that extend within the slot 36 and engage the terminations 42 (FIG. 8) on the printed circuit 22 of the pluggable module 12. In the exemplary embodiment, the mating segments 60 of the contacts 40 are arranged within a single row within the slot 36. The intermediate segments 62 extend from the mating segments 60 to the mounting feet 64.

Figure 7:
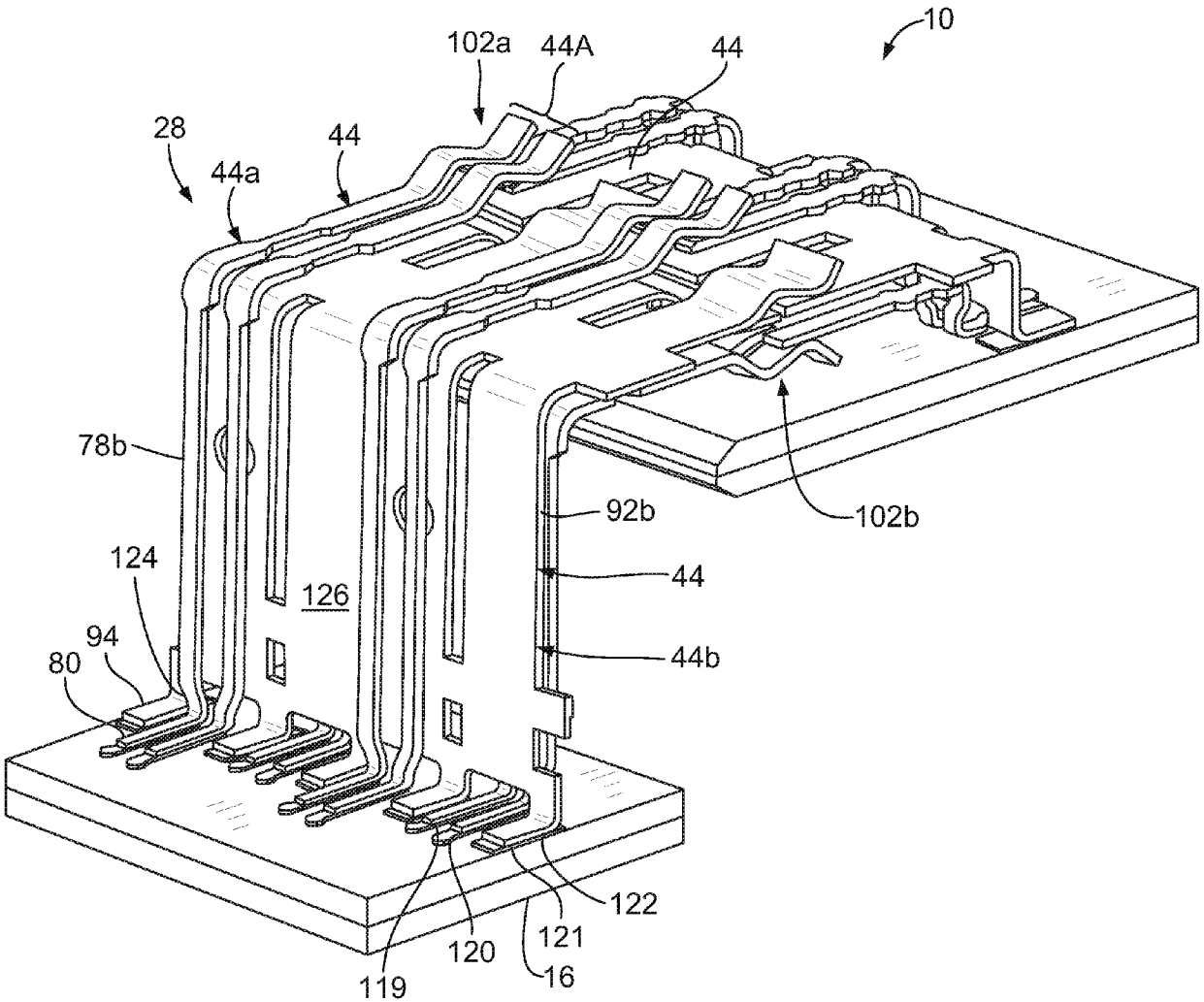
FIG. 7 is a perspective view of the portion of the transceiver assembly shown in FIG. 5 taken from a different angle than FIG. 5.

The mounting feet 64 of the contacts 40 extend along the front end 48 of the housing 32. In the exemplary embodiment, the mounting foot 64 of each contact 40 is configured to be surface mounted to the host printed circuit 16 (FIGS. 1, 2, and 7). More particularly, and as can be seen in FIG. 2, the mounting feet 64 are mounted on corresponding terminations 68 on the host printed circuit 16 in electrical and/or optical connection therewith. In an alternative embodiment, one or more of the contacts 40 is mounted on the host printed circuit 16 using another type of mounting than surface mounting, such as, but not limited to, using a compliant pin (instead of the mounting foot 64) that is received within a via (not shown) of the host printed circuit 16. The mating segment 60 of each contact 40 may be referred to herein as a "slot mating segment". The intermediate segment 62 of each contact 40 may be referred to herein as a "slot intermediate segment". The mounting foot 64 of each contact 40 may be referred to herein as a "slot mounting foot".

The receptacle connector 28 may include any number of the contacts 40. Each of the contacts 40 may be a signal contact, a ground contact, or a power contact. Optionally, contacts 40 used as signal contacts may be arranged in pairs with each signal contact within a pair conveying a differential signal, thus defining one or more differential pairs. Within the arrangement of the contacts 40, one or more ground contacts may be provided between adjacent differential pairs of signal contacts. Any other contact arrangement of the contacts 40 may be provided.

The housing 32 of the receptacle connector 28 holds the contacts 44 that mate with the plug connector 38 of the pluggable module 12. In the exemplary embodiment, the mating interface 34 of the housing 32 includes a plurality of mating receptacles 70 that extend through the front end 48 of the housing 32. The contacts 44 extend within corresponding mating receptacles 70. Each mating receptacle 70 receives a corresponding plug 72 (FIG. 4) of the plug connector 38 therein when the receptacle connector 28 is mated with the plug connector 38. As will be described below, the contacts 44 within each mating receptacle 70 engage the terminals 46 of the corresponding plug 72 when the plug 72 is received within the mating receptacle 70. Although eight are shown, the mating interface 34 of the housing 32 may include any number of the mating receptacles 70 for receiving any number of plugs 72. In one alternative embodiment, the plug connector 38 includes a plurality of the plugs 72 and the mating interface 34 of the housing 32 includes a single mating receptacle 70 that receives all of the plugs 72 therein.

Figure 5:
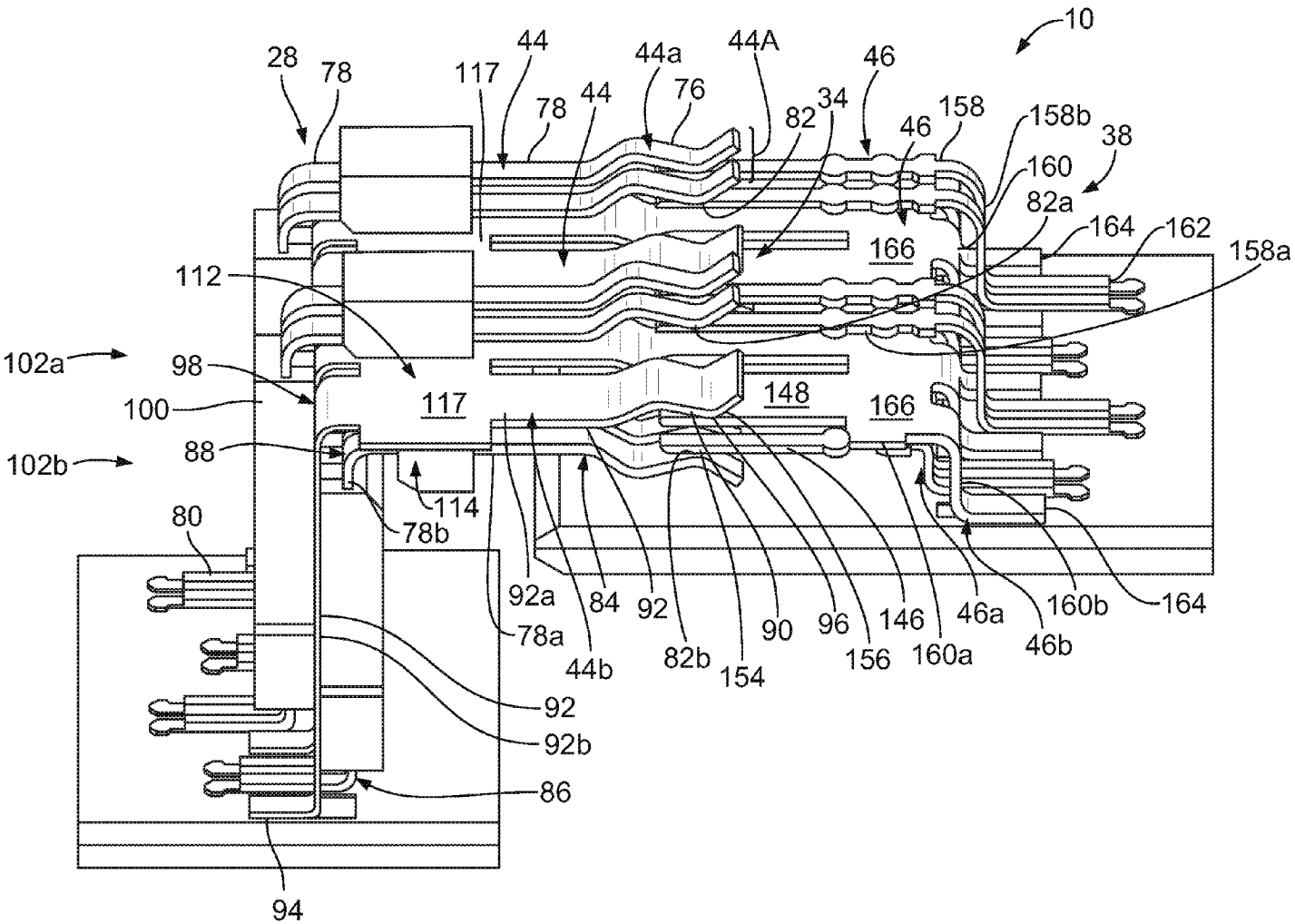
FIG. 5 is a perspective view of a portion of the transceiver assembly shown in FIG. 1.

FIG. 5 is a perspective view of a portion of the transceiver assembly 10 illustrating the contacts 44 of the receptacle connector 28 and the terminals 46 of the plug connector 38. The housing 32 (FIGS. 2-4) of the receptacle connector 28 and a housing 74 (FIGS. 4 and 8) of the plug connector 38 have been removed from FIG. 5 for clarity. Moreover, FIG. 5 only illustrates half of the contacts 44 of the receptacle connector 28 and half of the terminals 46 of the plug connector 38. In other words, only the contacts 44 of four of the mating receptacles 70 and only the terminals 46 of four of the plugs 72 are shown in FIG. 5. The contacts 44 of the receptacle connector 28 include signal contacts 44*a* and ground contacts 44*b*. In the exemplary embodiment, the signal contacts 44*a* are arranged in differential pairs 44A. Alternatively, some or all of the signal contacts 44*a* are not arranged in differential pairs. Although only eight signal contacts 44*a* are shown in FIG. 5, and although the exemplary embodiment of the receptacle connector 28 includes sixteen signal contacts 44*a* (which should be apparent from FIGS. 3 and 4), the receptacle connector 28 may include any number of the signal contacts 44*a*, including any number of differential pairs. Similarly, the receptacle connector 28 may include any number of the ground contacts 44*b*. In the exemplary embodiment, the receptacle connector 28 includes eight ground contacts 44*b*, only four of which are shown in FIG. 5. The housing 74 of the plug connector 38 may be referred to herein as a "plug housing". Each of the signal contacts 44*a* may be referred to herein as a "first signal contact" and/or a "second signal contact".

Each signal contact 44*a* includes a mating segment 76, an intermediate segment 78, and a mounting foot 80. The mating segments 76 extend along the mating interface 34 of the housing 32 and include mating surfaces 82 that also extend along the mating interface 34. More particularly, the mating segments 76 extend within corresponding mating receptacles 70 (FIG. 3) of the housing 32 such that the mating surfaces 82 are exposed within the mating receptacles 70 for engagement with the corresponding terminals 46 of the corresponding plugs 72 (FIG. 4). In the exemplary embodiment, for each differential pair 44A, the mating segments 76 thereof extend within the same mating receptacle 70. Each mating segment 76 may be referred to herein as a "signal mating segment" and/or a "receptacle mating segment", while each mating surface 82 may be referred to herein as a "signal mating surface", a "first signal mating surface", and/or a "second signal mating surface".

The intermediate segment 78 of each signal contact 44*a* extends from the mating segment 76 to the mounting foot 80. Specifically the intermediate segment 78 extends from an end 84 to an opposite end 86. The mating segment 76 extends from the end 84 of the intermediate segment 78, while the mounting foot 80 extends from the opposite end 86 of the intermediate segment 78. The intermediate segment 78 includes a bend 88 that divides the intermediate segment 78 into two intermediate sub-segments 78*a* and 78*b*. The sub-segment 78*a* includes the end 84, while the sub-segment 78*b* includes the opposite end 86. Although shown as having an angle of approximately 90°, the bend 88 may have any angle. Moreover, alternatively the intermediate segment 78 does not include the bend 88. The intermediate segment 78 of each signal contact 44*a* may be referred to herein as a "signal intermediate segment" and/or a "receptacle intermediate segment". The mounting foot 80 of each signal contact 44*a* may be referred to herein as a "receptacle mounting foot" and/or a "signal mounting foot".

The ground contacts 44*b* include mating segments 90, intermediate segments 92, and mounting feet 94. The mating segments 90 extend along the mating interface 34 of the housing 32 and include mating surfaces 96 that also extend along the mating interface 34. The mating segments 90 extend within corresponding mating receptacles 70 of the housing 32 such that the mating surfaces 96 are exposed within the mating receptacles 70 for engagement with the corresponding terminals 46 of the corresponding plugs 72. In the exemplary embodiment, the mating segment 90 of each ground contact 44*b* extends within the same mating receptacle 70 as a corresponding one of the differential pairs 44A of the signal contacts 44*a*. The intermediate segment 92 of each ground contact 44*b* extends from the mating segment 90 to the mounting foot 94. The intermediate segment 92 includes a bend 98 that divides the intermediate segment 92 into two intermediate sub-segments 92*a* and 92*b*. In the exemplary embodiment, the bend 98 has an angle of approximately 90°. But, the bend 98 may have any angle. In an alternative embodiment, the intermediate segment 92 does not include the bend 98.

Each mating segment 90 may be referred to herein as a "ground mating segment" and/or a "receptacle mating segment". The mating surfaces 96 may each be referred to herein as a "ground mating surface", while each intermediate segment 92 may be referred to herein as a "ground intermediate segment" and/or a "receptacle intermediate segment". The mounting feet 94 may each be referred to herein as a "receptacle mounting foot" and/or a "ground mounting foot".

Referring again to FIG. 2, the mounting feet 80 of the signal contacts 44*a* and the mounting feet 94 of the ground contacts 44*b* extend along the rear end 50 of the housing 32 of the receptacle connector 28. The mounting feet 80 and 94 extend in a different direction relative to the mounting feet 64 of the contacts 40. In the exemplary embodiment, each mounting foot 80 and 94 extends in an approximately opposite direction to each of the mounting feet 64. But, each mounting foot 80 and 94 may extend in any other direction, including the same direction, relative to each mounting foot 64. Exposure of the mounting feet 80 and 94 of the contacts 44 along the rear end 50 of the housing 32 may ease inspection of a joint between the mounting feet 80 and 94 and corresponding terminations 120 and 122 (FIG. 7), respectively on the host printed circuit 16.

Figure 6:
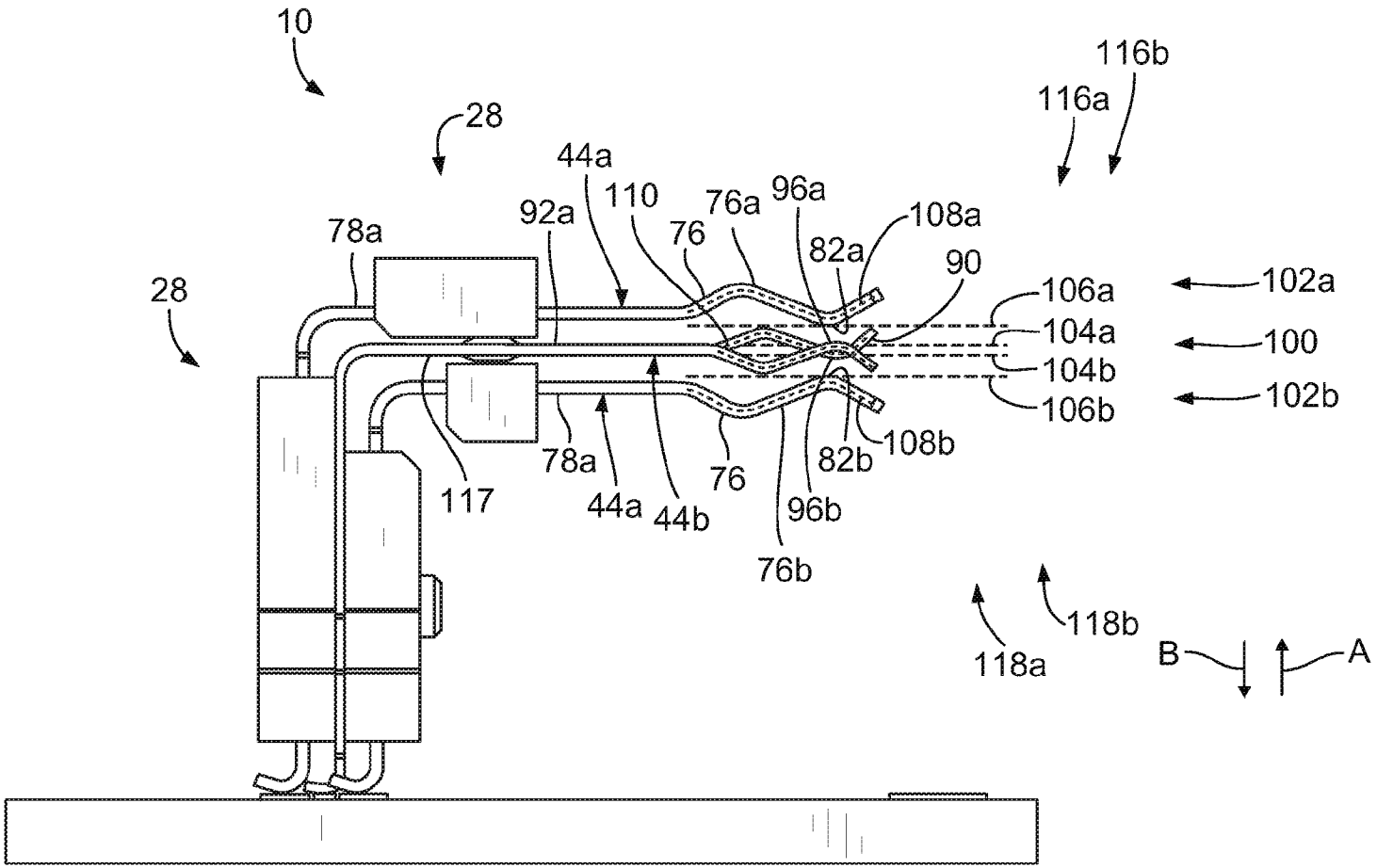
FIG. 6 is an elevational view of a portion of the transceiver assembly shown in FIG. 5 illustrating a portion of the receptacle connector.

FIG. 6 is an elevational view of a portion of the transceiver assembly 10 illustrating a portion of the receptacle connector 28. The housing 32 (FIGS. 2-4) of the receptacle connector 28 has been removed from FIG. 6 for clarity. The mating surfaces 82 of the signal contacts 44*a* extend out-of-plane relative to the mating surfaces 96 of the ground contacts 44*b*. The mating segments 90 of the ground contacts 44*b* are arranged side-by-side within a row 100. Alternating ground contacts 44*b* within the row 100 have mating surfaces 96*a* and 96*b* that face in opposite directions A and B, respectively. The mating segments 76 of the signal contacts 44*a* are arranged within at least one row 102 that is spaced apart from the row 100 of the mating segments 90 of the ground contacts 44*b*. In the exemplary embodiment, the mating segments 76 of the signal contacts 44*a* are arranged within two rows 102*a* and 102*b* that are each spaced apart from the row 100 of ground contacts 44*b*. Specifically, a group 76*a* of the mating segments 76 of the signal contacts 44*a* are arranged within the row 102*a*, which is spaced apart from the row 100 in the direction A (above the row 100 as viewed in FIG. 6). A group 76*b* of the mating segments 76 of the signal contacts 44*a* are arranged within the row 102*b*, which is spaced apart from the row 100 in the direction B (below the row 100 as viewed in FIG. 6). As can be seen in FIG. 6, the rows 102*a* and 102*b* are spaced apart from each other and the row 100 extends between the rows 102*a* and 102*b*. The mating segments 76 of the signal contacts 44*a* may be arranged in any number of rows. The mating segments 90 of the ground contacts 44*b* may be arranged in any number of rows. The row 100 may be referred to herein as a "ground row", a "first row", and/or a "second row", while the rows 102*a* and 102*b* may each be referred to herein as a "signal row", "a first row", a "second row", a "first signal row", and/or a "second signal row". The signal contacts 44*a* having the group 76*a* of mating segments 76 arranged within the row 102*a* may be referred to herein as a "first group" and/or a "second group" of the signal contacts 44*a*, and the signal contacts 44*a* having the group 76*b* of mating segments 76 arranged within the row 102*b* may be referred to herein as a "first group" and/or a "second group" of the signal contacts 44*a*.

The mating surfaces 96*a* and 96*b* within the row 100 of ground contacts 44*b* extend within respective ground planes 104*a* and 104*b*. The rows 102*a* and 102*b* of the signal contacts 44*a* have respective mating surfaces 82*a* and 82*b* that extend within signal planes 106*a* and 106*b*, respectively. The signal planes 106*a* and 106*b* extend parallel to the ground planes 104*a* and 104*b*. But, each of the signal planes 106*a* and 106*b* is spaced apart from each of the ground planes 104*a* and 104*b* such that the mating surfaces 82*a* and 82*b* extend out-of-plane relative to the mating surfaces 96*a* and 96*b*. Specifically, the signal plane 106*a* is spaced apart from each of the ground planes 104*a* and 104*b* in the direction A, or in other words above the ground planes 104*a* and 104*b* as viewed in FIG. 6. The signal plane 106*a* thus extends along sides 116*a* and 116*b* of the ground planes 104*a* and 104*b*, respectively. The signal plane 106*b* is spaced apart from each of the ground planes 104*a* and 104*b* in the direction B, or in other words below the ground planes 104*a* and 104*b* as viewed in FIG. 6. The signal plane 106*b* thus extends along sides 118*a* and 118*b* of the ground planes 104*a* and 104*b*, respectively, that are opposite the sides 116*a* and 116*b*, respectively. In the exemplary embodiment, the signal planes 106*a* and 106*b* are spaced apart from each other and the ground planes 104*a* and 104*b* extend between the signal planes 106*a* and 106*b*. Each of the sides 116*a*, 116*b*, 118*a*, and 118*b* may be referred to herein as a "first side" and/or a "second side".

Spacing the signal planes 106*a* and 106*b* apart from each other with the ground planes 104*a* and 104*b* extending therebetween and/or spacing the signal planes 106*a* and 106*b* apart from each of the ground planes 104*a* and 104*b* may facilitate controlling an impedance of the receptacle connector 28, which may include controlling both a differential and common mode impedance. Controlling the impedance of the receptacle connector 28 may reduce impedance discontinuities between the transceiver assembly 10 and the host equipment and/or the external device. Spacing the signal planes 106*a* and 106*b* apart from each other with the ground planes 104*a* and 104*b* extending therebetween and/or spacing the signal planes 106*a* and 106*b* apart from each of the ground planes 104*a* and 104*b* may facilitate reducing an amount of crosstalk, signal attenuation, and/or the like of the receptacle connector 28. Each signal plane 106*a* and 106*b* may be spaced apart from each of the ground planes 104*a* and 104*b*, and the signal planes 106*a* and 106*b* may be spaced apart from each other, by any amount, which may be selected to provide the receptacle connector 28 with a predetermined amount of impedance, a predetermined amount of differential mode impedance, a predetermined amount of common mode impedance, and/or a predetermined amount of reduction or elimination of crosstalk, signal attenuation, and/or the like. The signal planes 106*a* and 106*b* may each be referred to herein as a "first signal plane" and/or a "second signal plane".

Optionally, the entirety of each of the mating segments 76*a* and 76*b* extends out-of-plane relative to each of the mating segments 90 of the ground contacts 44*b*. For example, a longitudinal axis 108*a* and 108*b* of each of the mating segments 76*a* and 76*b*, respectively, is spaced apart from a longitudinal axis 110 of each of the mating segments 90 of the ground contacts 44*b* along the entirety of the length of the axis 108*a* and 108*b*, as can be seen in FIG. 6. The entirety of the intermediate sub-segment 78*a* of each of the signal contacts

44*a* optionally extends out-of-plane relative to the intermediate sub-segment 92*a* of each of the ground contacts 44*b*.

Referring again to FIG. 5, the mating surfaces 82 of adjacent differential pairs 44A of the signal contacts 44*a* are optionally staggered on opposite sides 112 and 114 of the row 100 ground contacts 44*b*. Differential pairs 44A of the signal contacts 44*a* are arranged within the row 102*a*, which includes the signal mating surfaces 82*a* that extend along the sides 116*a* and 116*b* (FIG. 6) of the ground planes 104*a* and 104*b* (FIG. 6), respectively. Differential pairs 44A of the signal contacts 44*a* are also arranged within the row 102*b*, which includes the signal mating surfaces 82*b* that extend along the sides 118*a* and 118*b* (FIG. 6) of the ground planes 104*a* and 104*b*, respectively. As can be seen in FIG. 5, adjacent differential pairs 44A alternate between the rows 102*a* and 102*b*. Staggering adjacent differential pairs 44A on opposite sides 112 and 114 of the row 100 of ground contacts 44*b* may facilitate controlling an impedance of the receptacle connector 28, which may include controlling both a differential and common mode impedance. Controlling the impedance of the receptacle connector 28 may reduce impedance discontinuities between the transceiver assembly 10 and the host equipment and/or the external device. Staggering adjacent differential pairs 44A on opposite sides 112 and 114 of the row 100 of ground contacts 44*b* may facilitate reducing an amount of crosstalk, signal attenuation, and/or the like of the receptacle connector 28 by isolating adjacent differential pairs 44A from each other using the mating segments 90 of the ground contacts 44*b*. Each differential pair 44A may be referred to herein as a "first differential pair" and/or a "second differential pair".

In the exemplary embodiment, the intermediate sub-segments 92*a* of the ground contacts 44*b* are mechanically and electrically connected together to form a common ground plate 117. As best seen in FIG. 6, the ground plate 117 extends between the rows 102*a* and 102*b* of the signal contacts 44*a*. The ground plate 117 may facilitate controlling an impedance of the receptacle connector 28, which may include controlling both a differential and common mode impedance. Controlling the impedance of the receptacle connector 28 may reduce impedance discontinuities between the transceiver assembly 10 and the host equipment and/or the external device. The ground plate 117 may facilitate reducing an amount of crosstalk, signal attenuation, and/or the like of the receptacle connector 28 by isolating the intermediate sub-segments 78*a* of the signal contacts 44*a* within the row 102*a* from the intermediate sub-segments 78*a* within the row 102*b*.

FIG. 7 is a perspective view of a portion of the transceiver assembly 10 illustrating a mounting interface between the contacts 44 of the receptacle connector 28 and the host printed circuit 16. In the exemplary embodiment, the mounting feet 80 and 94 of the signal and ground contacts 44*a* and 44*b*, respectively, are configured to be surface mounted to the host printed circuit 16. More particularly, the mounting feet 80 and 94 include respective mounting surfaces 119 and 121 that are mounted on corresponding terminations 120 and 122, respectively, on the host printed circuit 16 in electrical and/or optical connection therewith. In an alternative embodiment, one or more of the contacts 44 is mounted on the host printed circuit 16 using another type of mounting than surface mounting, such as, but not limited to, using a compliant pin (instead of the mounting feet 80 and/or 94) that is received within a via (not shown) of the host printed circuit 16. The mounting surfaces 119 may each be referred to herein as a "signal mounting surface", while the mounting surfaces 121 may each be referred to herein as a "ground mounting surface".

Optionally, the mounting surfaces 119 of the mounting feet 80 of the signal contacts 44*a* extend co-planar with the mounting surfaces 121 of the mounting feet 94 of the ground contacts 44*b*. The co-planar arrangement of the mounting surfaces 119 and 121 enables the signal and ground contacts 44*a* and 44*b*, respectively, to be mounted on the same plane of the host printed circuit 16 despite having the mating surfaces 82 and 96, respectively, that are arranged in different planes. Accordingly, while the signal contacts 44*a* extend within different planes than the ground contacts 44*b* at the mating interface 34 with the pluggable module 12, the signal contacts 44*a* extend within the same plane as the ground contacts 44*b* at the mounting interface with the host printed circuit 12. As can be seen in FIG. 7, the mounting feet 80 of the signal contacts 44*a* having the mating segments 76*b* that extend within the row 102*b* extend below the intermediate sub-segments 92*b* of corresponding ground contacts 44*b* to enable the mounting surfaces 119 of the mounting feet 80 to extend co-planar with the mounting surfaces 121 of the ground contacts 44*b* and the mounting surfaces 119 of the signal contacts 44*a* having the mating segments 76*a* that extend within the row 102*a*. Optionally, the mounting feet 80 of the row 102*a* of the signal contacts 44*a* extend in approximately the same direction as the mounting feet 80 of the row 102*b* of the signal contacts 44*a*. The mounting feet 80 of the rows 102*a* and/or 102*b* of the signal contacts 44*a* optionally extend in approximately the same direction as the mounting feet 94 of the ground contacts 44*b*.

The intermediate sub-segments 78*b* of the signal contacts 44*a* optionally include bends 124 that space the intermediate sub-segments 78*b* of the signal contacts 44*a* within each differential pair 44A further apart from each other than the mounting feet 80 thereof. The bends 124 may have any angle, length, and/or the like to provide any increased amount of spacing between the intermediate sub-segments 78*b*. Spacing the intermediate sub-segments 78*b* apart from each other further than the mounting feet 80 may facilitate an increased density, and/or a reduced pitch therebetween, of the terminations 120 on the host printed circuit 16.

Optionally, the intermediate sub-segments 92*b* of the ground contacts 44*b* are mechanically and electrically connected together to form a common ground plate 126. The ground plate 126 extends between the intermediate sub-segments 78*b* of the signal contacts 44*a* within the rows 102*a* and 102*b*. The ground plate 126 may facilitate controlling an impedance of the receptacle connector 28, which may include controlling both a differential and common mode impedance. Controlling the impedance of the receptacle connector 28 may reduce impedance discontinuities between the transceiver assembly 10 and the host equipment and/or the external device. The ground plate 126 may facilitate reducing an amount of crosstalk, signal attenuation, and/or the like of the receptacle connector 28 by isolating the intermediate sub-segments 78*b* of the signal contacts 44*a* within the row 102*a* from the intermediate sub-segments 78*b* of the signal contacts 44*a* within the row 102*b*.

Figure 8:
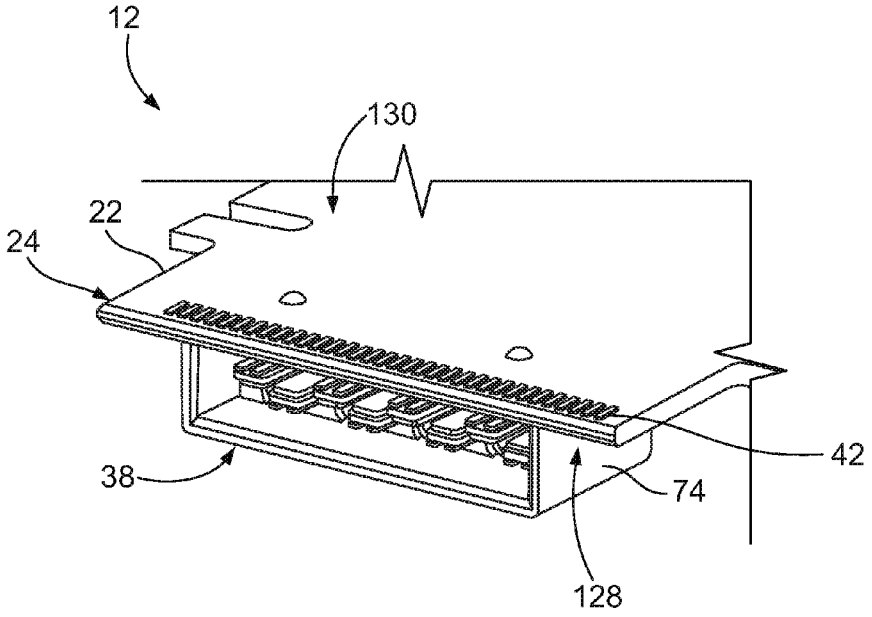
FIG. 8 is a perspective view of a portion of the pluggable module illustrating an exemplary embodiment of a printed circuit of the pluggable module.

FIG. 8 is a perspective view of a portion of the pluggable module 12. The pluggable module 12 includes the printed circuit 22, which includes opposite mounting and mating sides 128 and 130, respectively. The housing 74 of the plug connector 38 is mounted on the mounting side 128 of the printed circuit 22. Along the edge 24, the mating side 130 of the printed circuit 22 includes the terminations 42 that engage the mating surfaces 66 (FIG. 3) of the contacts 40 (FIGS. 2 and 3) when the edge 24 of the printed circuit 22 is received within the slot 36 (FIGS. 2 and 3) of the receptacle connector 28 (FIGS. 1-7). In the exemplary embodiment, the terminations 42 are arranged within a single row along the edge 24 of the printed circuit 22. The printed circuit 22 may include any number of the terminations 42 for mating with any number of the contacts 40.

Referring again to FIG. 4, the housing 74 of the plug connector 38 extends from a front end 132 to a rear end 134 and includes a bottom side 136. The housing 74 is mounted on the printed circuit 22 at the bottom side 136. The front end 132 of the housing 74 includes a mating interface 138 for mating with the receptacle connector 28. In the exemplary embodiment, the mating interface 138 is defined by an opening that extends through the front end 132 of the housing 74 and toward the rear end 134.

The housing 74 of the plug connector 38 holds the plugs 72 that mate with the receptacle connector 28. The plugs 72 extend along the mating interface 138 and along the mounting side 128 of the printed circuit 22 for reception within the corresponding mating receptacle 70 (FIG. 3) of the receptacle connector 28. Each plug 72 includes a dielectric platform 140 having opposite sides 142 and 144. The plugs 72 include the terminals 46. The terminals 46 include signal terminals 46*a* and ground terminals 46*b*. In the exemplary embodiment, the signal terminals 46*a* are arranged in differential pairs 46A. Alternatively, some or all of the signal terminals 46*a* are not arranged in differential pairs. The plug connector 38 may include any number of the signal terminals 46*a*, including any number of differential pairs, and any number of the ground terminals 46*b*. Although eight are shown, the mating interface 138 of the housing 74 may include any number of the plugs 72 for being received within any number of the mating receptacles 70. Each of the sides 142 and 144 may be referred to herein as a "first side" and/or a "second side". The plugs 72 may each be referred to herein as a "first plug" and/or a "second plug". The signal terminals 46*a* may each be referred to herein as a "signal contact", while the ground terminals 46*b* may each be referred to herein as a "ground contact".

On each platform 140, one of the sides 142 or 144 includes a mating segment 146 of one or more of the signal terminals 46*a*, and the other side 142 or 144 includes a mating segment 148 of one or more of the ground terminals 46*b*. In the exemplary embodiment, one of the sides 142 or 144 of each platform 140 includes the mating segments 146 of a corresponding differential pair 46A of the signal terminals 46*a* thereon. The plugs 72 are arranged along the mating interface 138 within a row 150 that extends along a row axis 152. The arrangement of the mating segments 146 and 148 of the signal terminals 46*a* and ground terminals 46*b*, respectively, on the sides 142 and 144 of the platforms 140 of adjacent plugs 72 within the row 150 is inverted. Specifically, for each platform 140 that includes the mating segments 146 of the corresponding signal terminals 46*a* on the side 142 and the mating segment 148 of the corresponding ground terminal 46*b* on the side 144, the plugs 72 that are adjacent thereto within the row 150 include the mating segments 146 of the corresponding signal terminals 46*a* on the side 144 and the mating segment 148 of the corresponding ground terminal 46*b* on the side 142.

Referring again to FIG. 5, the mating segments 146 and 148 of the signal and ground terminals 46*a* and 46*b*, respectively, include respective mating surfaces 154 and 156. When the plug connector 38 is mated with the receptacle connector 28, the mating surfaces 154 of the signal terminals 46*a* of the plugs 72 engage the mating surfaces 82 of the corresponding signal contacts 44*a* of the receptacle connector 28. Similarly, the mating surfaces 156 of the ground terminals 46*b* of the plugs 72 engage the mating surfaces 96 of the corresponding ground contacts 44*b* of the receptacle connector 28. An electrical and/or optical connection between the receptacle connector 28 and the plug connector 38 is thereby established. The mating surfaces 154 may each be referred to herein as a "signal mating surface", while the mating surfaces 156 may each be referred to herein as a "ground mating surface".

The signal terminals 46*a* and the ground terminals 46*b* include intermediate segments 158 and 160, respectively, that extend from the respective mating segments 146 and 148 to respective mounting feet 162 and 164. The intermediate segments 158 include intermediate sub-segments 158*a* and 158*b*, while the intermediate segments 160 include intermediate sub-segments 160*a* and 160*b*. Optionally, the intermediate sub-segments 160*a* of the ground terminals 46*b* are mechanically and electrically connected together to form a common ground plate 166. The ground plate 166 may facilitate controlling an impedance of the plug connector 38, which may include controlling both a differential and common mode impedance. Controlling the impedance of the plug connector 38 may reduce impedance discontinuities between the transceiver assembly 10 and the host equipment and/or the external device. The ground plate 166 may facilitate reducing an amount of crosstalk, signal attenuation, and/or the like of the plug connector 38 by isolating the intermediate sub-segments 158*a* of the signal contacts 44*a* of a differential pair 46A from the intermediate sub-segments 158*a* of other differential pairs 46A.

Figure 9:
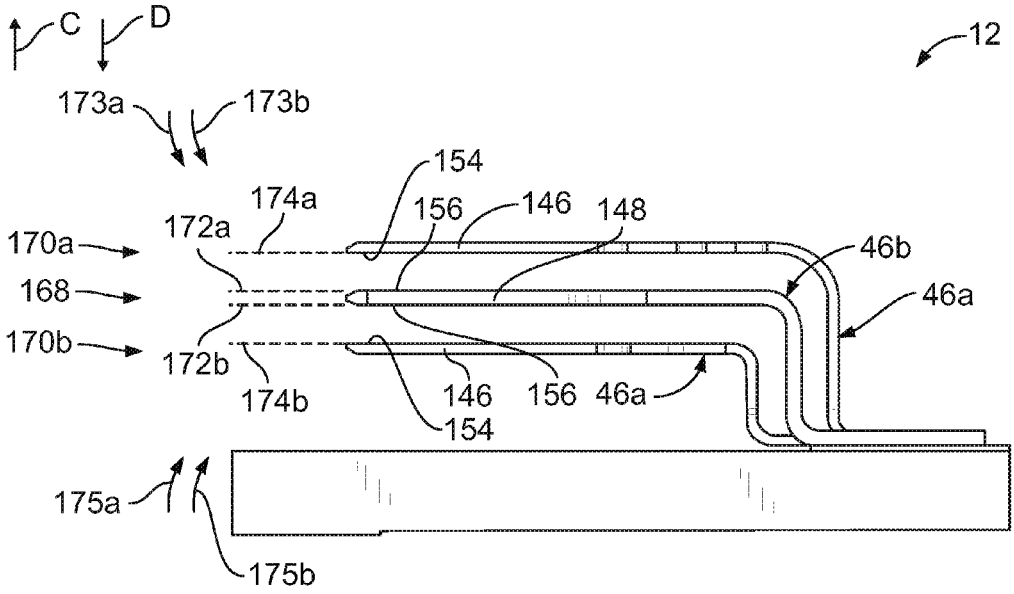
FIG. 9 is an elevational view of a portion of the pluggable module illustrating an exemplary embodiment of terminals of the pluggable module.

As can be seen in FIG. 4, in the exemplary embodiment, adjacent plugs 72 within the row 150 are staggered on opposite sides of the row axis 152. FIG. 9 is an elevational view of a portion of the pluggable module 12. The housing 74 of the plug connector 38 has been removed from FIG. 9 for clarity. The mating segments 148 of the ground terminals 46*b* are arranged side-by-side within a row 168. The mating segments 146 of the signal terminals 46*a* are arranged within at least one row 170 that is spaced apart from the row 168. In the exemplary embodiment, the mating segments 146 of the signal terminals 46*a* are arranged within two rows 170*a* and 170*b* that are each spaced apart from the row 168 of ground terminals 46*b* on opposite sides of the row 168, such that the row 168 extends between the rows 170*a* and 170*b*. The mating segments 146 of the signal terminals 46*a* may be arranged in any number of rows. The mating segments 148 of the ground terminals 46*b* may be arranged in any number of rows.

The mating surfaces 154 of the signal terminals 46*a* extend out-of-plane relative to the mating surfaces 156 of the ground terminals 46*b*. The mating surfaces 156 within the row 168 of ground terminals 46*b* extend within respective ground planes 172*a* and 172*b*. The rows 170*a* and 170*b* of the signal terminals 46*a* have mating surfaces 154 that extend within signal planes 174*a* and 174*b*, respectively. The signal planes 174*a* and 174*b* extend parallel to the ground planes 172*a* and 172*b*. But, each of the signal planes 174*a* and 174*b* is spaced apart from each of the ground planes 172*a* and 172*b*. Specifically, the signal plane 174*a* is spaced apart from each of the ground planes 172*a* and 172*b* in the direction C, or in other words above the ground planes 172*a* and 172*b* as viewed in FIG. 9. The signal plane 174*a* thus extends along sides 173*a* and 173*b* of the ground planes 172*a* and 172*b*, respectively. The signal plane 174*b* is spaced apart from each of the ground planes 172*a* and 172*b* in the direction D, or in other words below the ground planes 172*a* and 172*b* as viewed in FIG. 9. The signal plane 174*b* thus extends along sides 175*a* and 175*b* of the ground planes 172*a* and 172*b*, respectively, that are opposite the sides 173*a* and 173*b*, respectively. The ground planes 172*a* and 172*b* extend between the signal planes 174*a* and 174*b*.

Spacing the signal planes 174*a* and 174*b* apart from each other with the ground planes 172*a* and 172*b* extending therebetween and/or spacing the signal planes 174*a* and 174*b* apart from each of the ground planes 172*a* and 172*b* may facilitate controlling an impedance of the plug connector 38, which may include controlling both a differential and common mode impedance. Controlling the impedance of the plug connector 38 may reduce impedance discontinuities between the transceiver assembly 10 and the host equipment and/or the external device. Spacing the signal planes 174*a* and 174*b* apart from each other with the ground planes 172*a* and 172*b* extending therebetween and/or spacing the signal planes 174*a* and 174*b* apart from each of the ground planes 172*a* and 172*b* may facilitate reducing an amount of crosstalk, signal attenuation, and/or the like of the plug connector 38. Each signal plane 174*a* and 174*b* may be spaced apart from each of the ground planes 172*a* and 172*b*, and the signal planes 174*a* and 174*b* may be spaced apart from each other, by any amount. The amount of such spacings may be selected to provide the plug connector 38 with a predetermined amount of impedance, a predetermined amount of differential mode impedance, a predetermined amount of common mode impedance, and/or a predetermined amount of reduction or elimination of crosstalk, signal attenuation, and/or the like.

Figure 10:
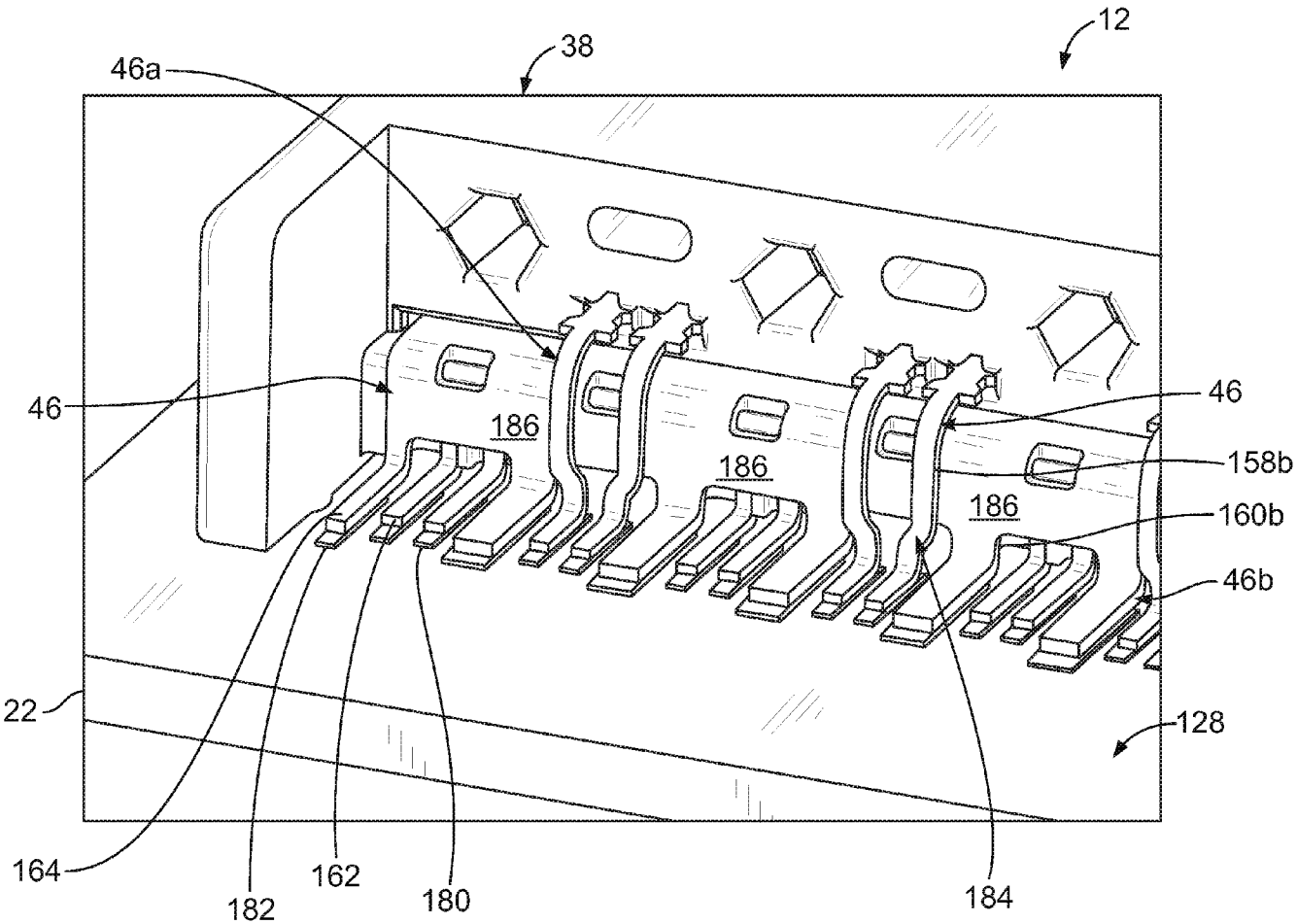
FIG. 10 is a perspective view of a portion of the pluggable module illustrating an exemplary embodiment of a mounting interface between an exemplary embodiment of a plug connector and the printed circuit of the pluggable module.

FIG. 10 is a perspective view of a portion of the pluggable module 12 illustrating a mounting interface between the terminals 46 of the plug connector 38 and the printed circuit 22. In the exemplary embodiment, the mounting feet 162 and 164 of the signal and ground terminals 46*a* and 46*b*, respectively, are configured to be surface mounted to the printed circuit 22. Specifically, the mounting feet 162 and 164 are mounted on corresponding terminations 180 and 182, respectively, on the printed circuit 22 in electrical and/or optical connection therewith. In an alternative embodiment, one or more of the terminals 46 is mounted on the printed circuit 22 using another type of mounting than surface mounting, such as, but not limited to, using a compliant pin (instead of the mounting feet 162 and/or 164) that is received within a via (not shown) of the printed circuit 22. As can be seen in FIG. 10, both the signal terminals 46*a* and the ground terminals 46*b* are mounted on the same side 128 of the printed circuit 22. Accordingly, the mating interface 34 (FIGS. 2, 3, and 5) of the receptacle connector 28 (FIGS. 1-7) mates only with terminals 46 that are mounted on the same side 128 of the printed circuit 22.

Optionally, the intermediate sub-segments 158*b* of the signal terminals 46*a* include bends 184 that space the intermediate sub-segments 158*b* of the signal terminals 46*a* within each differential pair 46A further apart from each other than the mounting feet 162 thereof. The bends 184 may have any angle, length, and/or the like to provide any increased amount of spacing between the intermediate sub-segments 158*b*. Spacing the intermediate sub-segments 158*b* apart from each other further than the mounting feet 162 may facilitate an increased density, and/or a reduced pitch therebetween, of the terminations 180 on the printed circuit 22. In the exemplary embodiment, the intermediate sub-segments 160*b* of the ground terminals 46*b* are mechanically and electrically connected together to form a common ground plate 186. The ground plate 186 extends between the intermediate sub-segments 158*b* of the signal terminals 46*a* within the rows 174*a* and 174*b* (FIG. 9). The ground plate 186 may facilitate controlling an impedance of the plug connector 38, which may include controlling both a differential and common mode impedance. Controlling the impedance of the plug connector 38 may reduce impedance discontinuities between the transceiver assembly 10 and the host equipment and/or the external device. The ground plate 186 may facilitate reducing an amount of crosstalk, signal attenuation, and/or the like of the plug connector 38 by isolating the intermediate sub-segments 158*b* of the signal terminals 46*a* within the row 174*a* from the intermediate sub-segments 158*b* of the signal terminals 46*a* within the row 174*b*.

As used herein, the term "printed circuit" is intended to mean any electric circuit in which the conducting connections have been printed or otherwise deposited in predetermined patterns on an electrically insulating substrate. Substrates of the printed circuits 16 and 22 may each be a flexible substrate or a rigid substrate. The substrates may be fabricated from and/or include any material(s), such as, but not limited to, ceramic, epoxy-glass, polyimide (such as, but not limited to, Kapton® and/or the like), organic material, plastic, polymer, and/or the like. In some embodiments, one or both of the substrates is a rigid substrate fabricated from epoxy-glass, such that the corresponding printed circuit 16 and/or 22 is what is sometimes referred to as a "circuit board" or a "printed circuit board".

It is to be understood that the Figures and the above description are intended to be illustrative, and not restrictive. For example, the embodiments (and/or aspects thereof) described and/or illustrated herein may be used in combination with each other. In addition, many modifications may be made to adapt a particular situation, component, structure, material, and/or the like to the teachings of the embodiments described and/or illustrated herein without departing from the scope thereof. Dimensions, types of materials, orientations of the various components, the number and positions of the various components described and/or illustrated herein, and/or the like are intended to define parameters of certain embodiments, and are by no means limiting and are merely exemplary embodiments. Many other embodiments and modifications within the spirit and scope of the claims will be apparent to those of skill in the art upon reviewing the Figures and the above description. The scope of the embodiments described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A receptacle connector for mating with a pluggable module having a plug and a printed circuit, said receptacle connector comprising:

a housing comprising a mating receptacle and a slot, the mating receptacle being configured to receive the plug of the pluggable module therein, the slot being configured to receive the printed circuit of the pluggable module therein;

first and second rows of receptacle contacts held by the housing, each of the receptacle contact comprising a receptacle mating segment that extends within the mating receptacle and is configured to engage a mating contact of the plug of the pluggable module, the first and second rows being spaced apart from each other, wherein the first row of receptacle contacts extends between the slot and the second row of receptacle contacts; and a slot contact held by the housing, the slot contact comprising a slot mating segment that extends within the slot and is configured to engage the printed circuit of the pluggable module.

2. The receptacle connector according to claim 1, wherein the receptacle contacts comprise mounting feet and intermediate segments that extend from the receptacle mating segments to the mounting feet, the mounting feet being configured to be mounted on a host printed circuit, wherein the mounting feet of the first row of receptacle contacts extend in approximately the same direction as the mounting feet of the second row of receptacle contacts.

3. The receptacle connector according to claim 1, wherein each of the receptacle contacts comprises a receptacle mounting foot and a receptacle intermediate segment that extends from the receptacle mating segment to the receptacle mounting foot, the slot contact comprising a slot mounting foot and a slot intermediate segment that extends from the slot mating segment to the slot mounting foot, wherein the receptacle mounting feet of the receptacle contacts extend in a different direction relative to the slot mounting foot of the slot contact.

4. The receptacle connector according to claim 1, wherein the housing extends from a rear end to a front end, the front end of the housing comprising the mating receptacle and the slot, each of the receptacle contacts comprising a receptacle mounting foot, the slot contact comprising a slot mounting foot, wherein the receptacle mounting feet extend along the rear end of the housing and the slot mounting foot extends along the front end of the housing.

5. The receptacle connector according to claim 1, wherein the receptacle contacts are configured to convey data signals at a data transmission rate of between approximately 20 gigabits per second (Gbps) and approximately 30 Gbps.

6. The receptacle connector according to claim 1, wherein the receptacle connector is configured to be mounted on a host printed circuit such that the slot extends approximately parallel to the host printed circuit.

7. A transceiver assembly comprising:

a pluggable module comprising a plug and a printed circuit, the plug comprising a mating contact; and a receptacle connector comprising:

a housing comprising a mating receptacle and a slot, the mating receptacle receiving the plug of the pluggable module therein, the slot receiving the printed circuit of the pluggable module therein;

first and second rows of receptacle contact held by the housing, each receptacle contact comprising a receptacle mating segment that extends within the mating receptacle and engages the mating contact of the plug, the first and second rows being spaced apart from each other, wherein the first row of receptacle contacts extends between the slot and the second row of receptacle contacts; and a slot contact held by the housing, the slot contact comprising a slot mating segment that extends within the slot and engages the printed circuit.

8. The transceiver assembly according to claim 7, wherein the printed circuit of the pluggable module comprises opposite mounting and mating sides and the housing of the receptacle connector is a receptacle housing, the pluggable module comprising a plug housing that holds the plug, the plug housing of the pluggable module being mounted on the mounting side of the printed circuit such that the plug extends along the mounting side, the mating side of the printed circuit comprising a termination engaging the slot contact of the receptacle connector.

9. The transceiver assembly according to claim 7, wherein the printed circuit of the pluggable module is a module printed circuit, the receptacle contacts comprising mounting feet and intermediate segments that extend from the receptacle mating segments to the mounting feet, the mounting feet being configured to be mounted on a host printed circuit, wherein the mounting feet of the first row of receptacle contacts extend in approximately the same direction as the mounting feet of the second row of receptacle contacts.

10. The transceiver assembly according to claim 7, wherein each receptacle contact comprises a receptacle mounting foot and a receptacle intermediate segment that extends from the receptacle mating segment to the receptacle mounting foot, the slot contact comprising a slot mounting foot and a slot intermediate segment that extends from the slot mating segment to the slot mounting foot, wherein the receptacle mounting feet extend in a different direction relative to the slot mounting foot of the slot contact.

11. The transceiver assembly according to claim 7, wherein the housing extends from a rear end to a front end, the front end of the housing comprising the mating receptacle and the slot, the receptacle contact comprising a receptacle mounting feet, the slot contact comprising a slot mounting foot, wherein the receptacle mounting feet extend outwardly from the housing at the rear end and the slot mounting foot extends outwardly from the housing at the front end.

12. The transceiver assembly according to claim 7, wherein the receptacle contact is configured to convey data signals at a higher rate than the slot contact.

13. The transceiver assembly according to claim 7, wherein the receptacle contact is configured to convey data signals at a data transmission rate of between approximately 20 Gbps and approximately 30 Gbps.

14. The transceiver assembly according to claim 7, wherein the printed circuit of the pluggable module is a module printed circuit, the receptacle connector being configured to be mounted on a host printed circuit, the slot of the housing extending between the first and second rows of receptacle contacts and the host printed circuit when the receptacle connector is mounted to the host printed circuit.

15. A transceiver assembly comprising:

a pluggable module having a module printed circuit and a plug that includes a mating contacts;

a host printed circuit; and a receptacle connector mounted on the host printed circuit, the receptacle connector comprising:

a housing comprising a mating receptacle and a slot, the mating receptacle receiving the plug of the pluggable module therein, the slot receiving the module printed circuit of the pluggable module therein;

first and second rows of receptacle contacts held by the housing, each receptacle contact comprising a receptacle mating segment that extends within the mating receptacle and engages the mating contact of the plug of the pluggable module, wherein the slot of the housing extends between the first and second rows of receptacle contacts and the host printed circuit; and a slot contact held by the housing, the slot contact comprising a slot mating segment that extends within the slot and engages the printed circuit of the pluggable module.

16. The transceiver assembly according to claim 15, wherein the receptacle contact comprise mounting feet and intermediate segments that extend from the receptacle mating segments to the mounting feet, the mounting feet being mounted on the host printed circuit, wherein the mounting feet of the first row of receptacle contacts extend in approximately the same direction as the mounting feet of the second row of receptacle contacts.

17. The transceiver assembly according to claim 15, wherein each receptacle contact comprises a receptacle mounting foot and a receptacle intermediate segment that extends from the receptacle mating segment to the receptacle mounting foot, the slot contact comprising a slot mounting foot and a slot intermediate segment that extends from the slot mating segment to the slot mounting foot, wherein the receptacle mounting foot extend in a different direction relative to the slot mounting foot of the slot contact.

18. The transceiver assembly according to claim 15, wherein the housing extends from a rear end to a front end, the front end of the housing comprising the mating receptacle and the slot, the receptacle contact comprising a receptacle mounting feet, the slot contact comprising a slot mounting foot, wherein the receptacle mounting feet extend along the rear end of the housing and the slot mounting foot extends along the front end of the housing.

19. The transceiver assembly according to claim 15, wherein the receptacle contact is configured to convey data signals at a higher rate than the slot contact.

* * * * *